US005769687A

United States Patent [19]

Ko

[11] Patent Number: 5,769,687

[45] Date of Patent: Jun. 23, 1998

[54] ROTATABLE TOY EYE

[76] Inventor: Lung Ching Ko, No. 8-1, Tzu Chiang 3rd Road, Nantou City, Nantou Hsien, Taiwan

[21] Appl. No.: 823,340

[22] Filed: Mar. 24, 1997

[51] Int. Cl.[6] ..... A63H 3/40

[52] U.S. Cl. ..... 446/343; 446/344

[58] Field of Search ..... 446/343–349

[56] References Cited

U.S. PATENT DOCUMENTS 2,136,006 11/1938 Fisher ..... 446/344 X

FOREIGN PATENT DOCUMENTS 363926 10/1938 Italy ..... 446/343

645123 9/1961 Italy ..... 446/344

*Primary Examiner*—Mickey Yu

[57] ABSTRACT

A toy eye includes an eye ball rotatably received in the housing and a spring for biasing against the eye ball and for positioning the eye ball in place. The eye ball includes a hole formed in the rear end for engaging with a pin which is secured on a disc. A flexible wire has one end secured to the disc and has the other end secured to a motor for allowing the motor to rotate the wire and the disc and for allowing the pin to rotate the eye ball.

5 Claims, 3 Drawing Sheets

ROTATABLE TOY EYE

BACKGROUND OF THE INVENTION

1. Field of the Invention

The present invention relates to an eye, and more particularly to a rotatable toy eye.

2. Description of the Prior Art

Typical toys comprise two eyes in which the eye balls may not be rotated and may not be maintained at any predetermined direction.

The present invention has arisen to mitigate and/or obviate the afore-described disadvantages of the conventional toy eyes.

SUMMARY OF THE INVENTION

The primary objective of the present invention is to provide a toy eye which includes an eye ball that may be maintained at any suitable direction and that may be rotated by rotating device.

In accordance with one aspect of the invention, there is provided a toy eye comprising a housing, an eye ball rotatably received in the housing, and means for rotating the eye ball.

A spring means is further provided for biasing against the eye ball and for positioning the eye ball in place.

The housing includes a front end having an annular flange extended radially inward for engaging with the eye ball and for preventing the eye ball from being disengaged from the housing.

The eye ball includes a rear end having a protrusion for engaging with the housing and for preventing the eye ball from being over rotated.

The eye ball includes a rear end having a hole, the rotating means includes a pin engaged in the hole of the eye ball, and means for actuating the pin and for rotating the eye ball.

The actuating means includes a cap secured to the housing and having an orifice, a disc rotatably engaged in the housing, and a wire having a first end engaged in the orifice of the cap and secured to the disc for rotating the disc and the pin.

The wire includes a second end, the actuating means further includes a first gear secured to the second end of the wire and includes a motor for rotating the first gear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
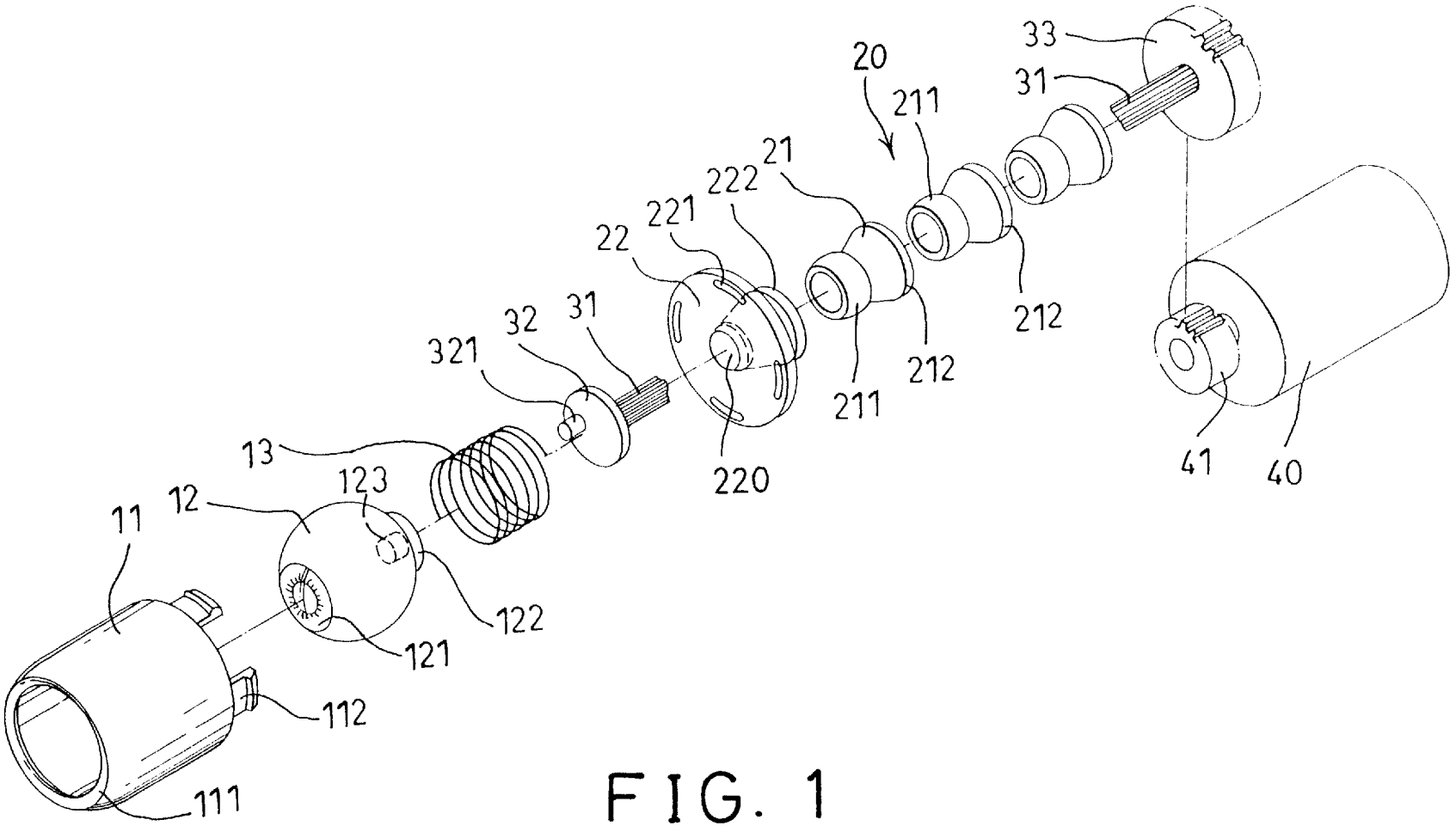
FIG. 1 is an exploded view of a rotatable toy eye in accordance with the present invention.
Figure 2:
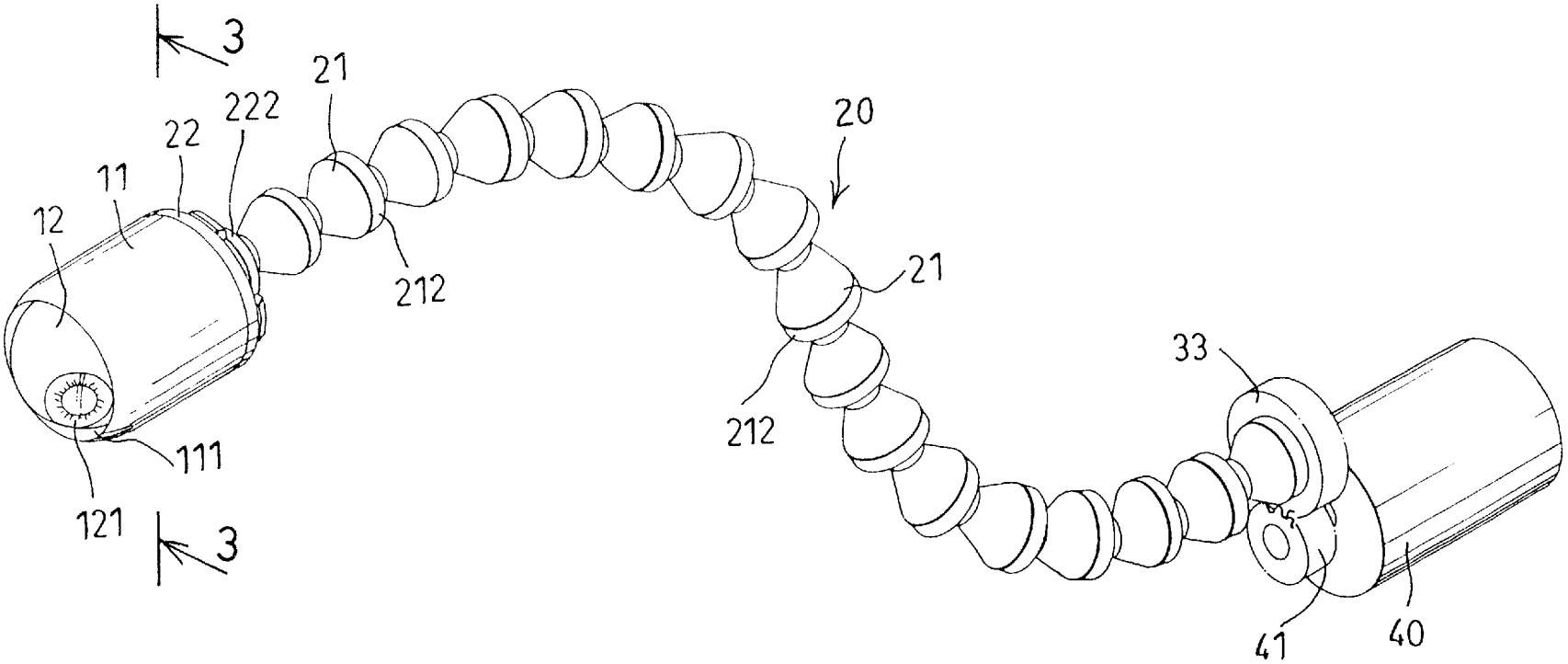
FIG. 2 is a perspective view of the toy eye.
Figure 3:
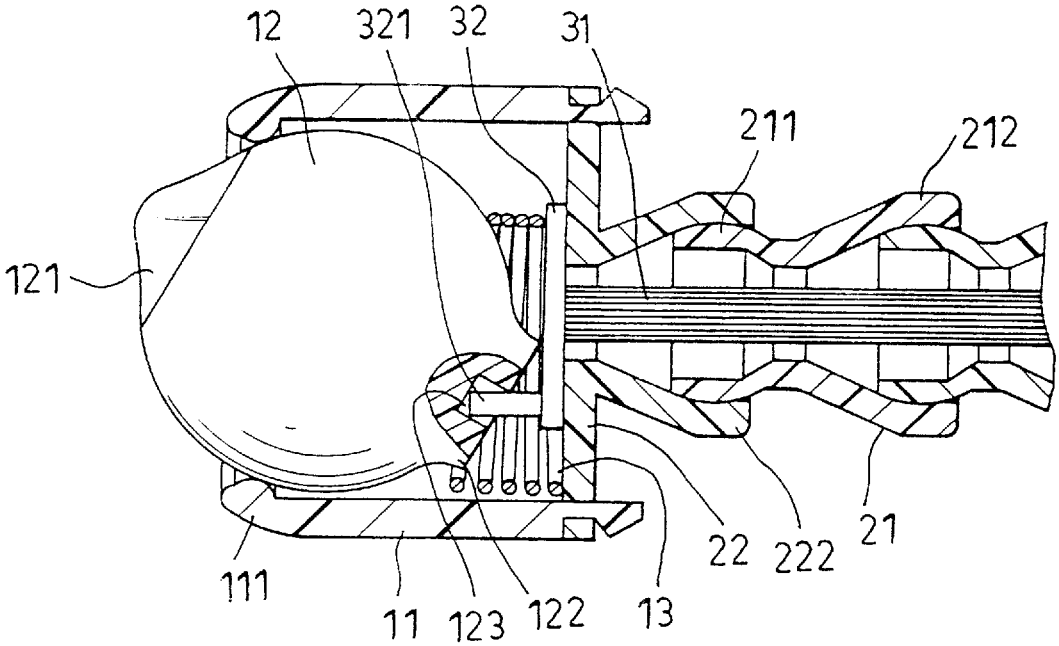
FIGS. 3 and 4 are cross sectional views illustrating the operation of the toy eye.
Figure 4:
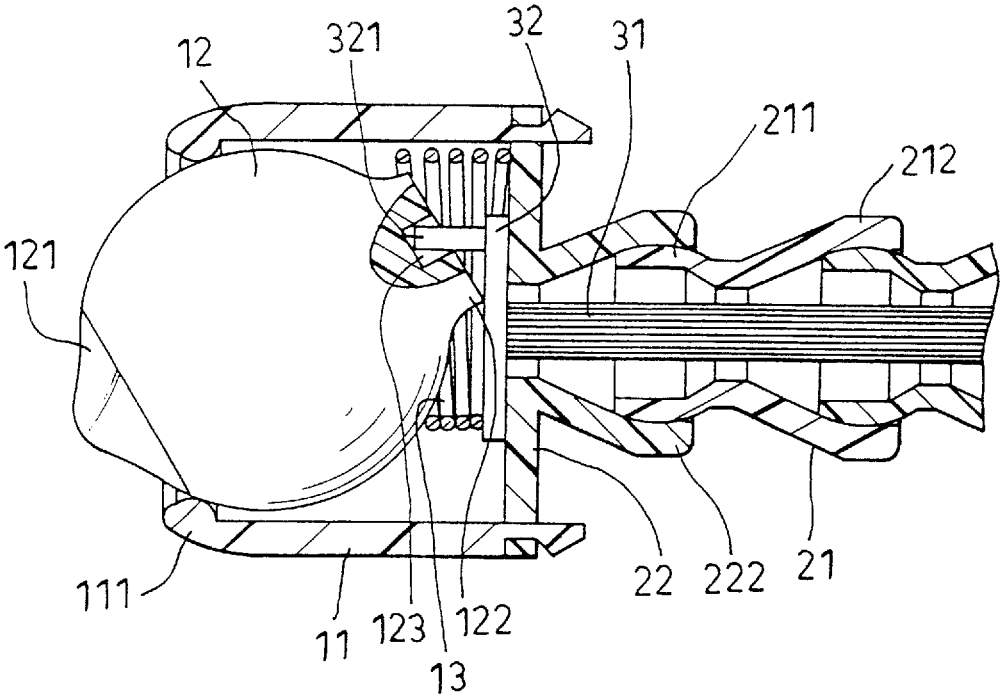

Referring to the drawings, and initially to FIGS. 1–3, a toy eye in accordance with the present invention comprises a housing 11 including an annular flange 111 formed in the front end and extended radially inward and including one or more catches 112 formed in the rear end. An eye ball 12 is rotatably received in the housing 11 and engaged with the annular flange 111 and has a lens of eye 121 extended outward of the housing 11. The eye ball 12 includes a protrusion 122 extended rearward and includes a hole 123 formed in the rear end. A cap 22 includes an orifice 220 and includes one or more openings 221 for engaging with the catches 112 and for enclosing the rear end of the housing 11. A spring 13 is biased between the eye ball 12 and the cap 22 for biasing against the eye ball 12 and for positioning the eye ball 12 at any desired angular position or at any suitable direction (FIGS. 3 and 4). The protrusion 122 is provided for engaging with the spring 13 and for engaging with the housing 11 and for preventing the eye ball 12 from being over rotated.

The cap 22 includes a frustum member 222 formed on the rear portion. A number of couplers 21 each includes a head 211 and a frustum member 212 for engaging with the head 211 and for forming a flexible tube 20. A flexible wire 31 is engaged in the flexible tube 20 and has one end engaged in the orifice 220 of the cap 22. A disc 32 is secured to one end of the wire 31 and rotatably engaged in the housing 11 and has a cam or eccentric pin 321 engaged in the hole 123 for allowing the pin 321 to rotate the eye ball 12 when the disc 32 is rotated by the wire 31. The wire 31 has a gear 33 secured to the other end for engaging with another gear 41 which is secured to and driven by a motor 40.

In operation, as shown in FIGS. 3 and 4, the eye ball 12 may be rotated by the pin 321 when the disc 32 is rotated by the motor 40 via the gears 33, 41 and the wire 31.

Accordingly, the toy eye in accordance with the present invention includes an eye ball that may be maintained at any suitable direction or at any desired angular position by the spring and may be rotated by the motor.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A toy eye comprising:

a housing, an eye ball rotatably received in said housing, said eye ball including a rear end having a hole, and means for rotating said eye ball, said rotating means including a pin engaged in said hole of said eye ball, and means for actuating said pin and for rotating said eye ball, said actuating means including a cap secured to said housing and having an orifice, a disc rotatably engaged in said housing, and a wire having a first end engaged in said orifice of said cap and secured to said disc for rotating said disc and said pin.

2. A toy eye according to claim 1 further comprising means for biasing against said eye ball and for positioning said eye ball in place.

3. A toy eye according to claim 1, wherein said housing includes a front end having an annular flange extended radially inward for engaging with said eye ball and for preventing said eye ball from being disengaged from said housing.

4. A toy eye according to claim 1, wherein said wire includes a second end, said actuating means further includes a first gear secured to said second end of said wire and includes a motor for rotating said first gear.

5. A toy eye according to claim 1 further comprising a flexible tube including a first end secured to said cap for receiving said wire.

* * * * *